US008515648B2

(12) United States Patent
Yoshizaki et al.

(10) Patent No.: US 8,515,648 B2
(45) Date of Patent: Aug. 20, 2013

(54) CONTROL DEVICE FOR INTERNAL COMBUSTION ENGINE

(75) Inventors: Satoshi Yoshizaki, Sunto-gun (JP); Shuntaro Okazaki, Gotemba (JP); Masashi Shibayama, Sunto-gun (JP); Kaoru Shokatsu, Susono (JP); Hajime Kawakami, Susono (JP)

(73) Assignee: Toyota Jidosha Kabushiki Kaisha, Toyota (JP)

( * ) Notice: Subject to any disclaimer, the term of this patent is extended or adjusted under 35 U.S.C. 154(b) by 0 days.

(21) Appl. No.: 13/320,691

(22) PCT Filed: Sep. 29, 2010

(86) PCT No.: PCT/JP2010/066935

§ 371 (c)(1),
(2), (4) Date: Nov. 15, 2011

(87) PCT Pub. No.: WO2012/042610

PCT Pub. Date: Apr. 5, 2012

(65) Prior Publication Data

US 2013/0184971 A1 Jul. 18, 2013

(51) Int. Cl.
*F02D 41/14* (2006.01)
*F02D 41/00* (2006.01)

(52) U.S. Cl.
USPC ..... 701/103; 123/406.23

(58) Field of Classification Search
USPC ..... 701/103, 104, 101, 102, 105; 123/683, 123/436, 406.23, 406.45, 406.47
See application file for complete search history.

(56) References Cited

U.S. PATENT DOCUMENTS 5,735,244 A * 4/1998 Machida et al. ..... 123/399
5,931,138 A * 8/1999 Uchida ..... 123/436

(Continued)

FOREIGN PATENT DOCUMENTS

JP A-11-343906 12/1999
JP A-2003-328809 11/2003

(Continued)

OTHER PUBLICATIONS

International Search Report in International Application No. PCT/JP2010/066935; dated Nov. 2, 2010 (with English-language translation).

*Primary Examiner* — Mahmoud Gimie
(74) *Attorney, Agent, or Firm* — Oliff & Berridge, PLC

(57) ABSTRACT

A control device for an internal combustion engine provided by the present invention is a control device which can enhance precision of realization of required torque while enhancing emission performance by positively changing an air-fuel ratio. The present control device generates a target air-fuel ratio by lessening a change speed of a required air-fuel ratio of an internal combustion engine. However, in a situation in which the required air-fuel ratio is made rich with return from fuel cut, lessening of the change speed of the required air-fuel ratio is stopped, and the required air-fuel ratio is directly outputted as a target air-fuel ratio. The control device calculates a target air quantity for realizing the required torque under the target air-fuel ratio. For calculation of the target air quantity, data in which relationship of torque generated by the internal combustion engine and an air quantity taken into a cylinder is fixed by being related to an air-fuel ratio can be used. The present control device manipulates an actuator for air quantity control in accordance with the target air quantity, and manipulates an actuator for fuel injection quantity control in accordance with the target air-fuel ratio.

2 Claims, 3 Drawing Sheets

(56) References Cited

U.S. PATENT DOCUMENTS

| | | | | |
|---|---|---|---|---|
| 5,988,141 | A * | 11/1999 | Uchida | 123/436 |
| 6,006,717 | A * | 12/1999 | Suzuki et al. | 123/295 |
| 2011/0098905 | A1* | 4/2011 | Ueda et al. | 701/102 |
| 2011/0191009 | A1* | 8/2011 | Soejima | 701/103 |

FOREIGN PATENT DOCUMENTS

| | | |
|---|---|---|
| JP | A-2005-140011 | 6/2005 |
| JP | A-2009-047102 | 3/2009 |
| JP | A-2009-167841 | 7/2009 |
| JP | A-2009-299667 | 12/2009 |

* cited by examiner

CONTROL DEVICE FOR INTERNAL COMBUSTION ENGINE

TECHNICAL FIELD

The present invention relates to a control device for an internal combustion engine, and particularly relates to a control device for an internal combustion engine which adopts torque and an air-fuel ratio as control variables.

BACKGROUND ART

As one of the control methods of internal combustion engines, there is known torque demand control which determines a manipulated variable of each actuator with toque as a control variable. Japanese Patent Laid-Open No. 2009-299667 describes one example of the control device which performs torque demand control. The control device described in Japanese Patent Laid-Open No. 2009-299667 (hereinafter, a conventional control device) is a control device which performs torque control by control of an air quantity by a throttle, control of an ignition timing by an ignition device, and control of a fuel injection quantity by a fuel supply system.

Incidentally, in addition to the quantity of the air which is taken into a cylinder, an air-fuel ratio is closely related to the torque which is generated by an internal combustion engine. Accordingly, in the conventional control device, the air-fuel ratio which is obtained from the present operation state information is referred to in the process of converting the required torque into a target value of the air quantity. The air-fuel ratio in this case does not mean the air-fuel ratio of the exhaust gas which is measured by an air-fuel ratio sensor, but means the air-fuel ratio of the mixture gas in the cylinder, that is, a required air-fuel ratio.

The required air-fuel ratio is not always constant, and is sometimes positively changed from the viewpoint of the emission performance. In such a case, according to the conventional control device, the target air quantity changes in accordance with change in the required air-fuel ratio, and a throttle opening is also controlled in correspondence with the target air quantity. The movement of the throttle at this time becomes such movement as to cancel out the torque variation accompanying the change of the air-fuel ratio by increase and decrease of the air quantity. That is to say, when the air-fuel ratio changes to a rich side, the throttle moves to the closing side so as to cancel out the increase in torque due to this by decrease in the air quantity. Conversely, when the air-fuel ratio changes to a lean side, the throttle moves to an opening side so as to cancel out the decrease in torque by increase in the air quantity.

However, there is a delay in the response of the air quantity to the movement of the throttle, and the actual air quantity changes late with respect to the change of the target air quantity. The delay becomes more noticeable as the change speed of the target air quantity is higher. Accordingly, in the conventional control device, change of the air quantity is unlikely to catch up with abrupt change of the air-fuel ratio when abrupt change takes place in the required air-fuel ratio. In this case, a deviation occurs between the torque generated by the internal combustion engine and the required torque, and not only torque control with high precision cannot be realized, but also worsening of emission performance can be caused due to unintended variation of the air-fuel ratio as a result.

As is known from the above, the conventional control device can be said to have a room for further improvement in the respect of the precision of realization of the required torque in the situation where the required air-fuel ratio can change.

CITATION LIST

Patent Literature

Patent Literature 1: Japanese Patent Laid-Open No. 2009-299667

Patent Literature 2: Japanese Patent Laid-Open No. 2009-47102

Patent Literature 3: Japanese Patent Laid-Open No. 2005-140011

SUMMARY OF INVENTION

As the solution to the aforementioned problem, it is conceivable to use the required air-fuel ratio with the change speed being lessened in calculation of the target air quantity. As the means which lessens the change speed of the required air-fuel ratio, a low-pass filter such as a first-order lag filter, moderating processing such as weighted average, or guard processing for a change rate can be cited. By lessening the change speed of the required air-fuel ratio, delay of change of the air quantity with respect to change of the air-fuel ratio can be eliminated. Alternatively, even though delay of the change of the air quantity with respect to change of the air-fuel ratio cannot be completely eliminated, the delay can be sufficiently reduced to the extent that torque variation does not occur.

However, it is not always preferable from the viewpoint of emission performance to lessen the change speed of the required air-fuel ratio indiscriminately without exception. More specifically, in the situation in which the required air-fuel ratio is made rich with return from fuel cut, the change speed of the required air-fuel ratio should not be lessened for the following reasons.

In the exhaust passage of an internal combustion engine, a catalytic device for purifying exhaust gas is provided. In the catalytic device, noble metal layers of platinum, palladium and rhodium are carried as a catalyst. Of them, rhodium has the function of reducing NOx and rendering NOx harmless as nitrogen. When fuel cut is carried out, the inside of the catalytic device is exposed to lean gas, whereby rhodium is brought into an oxidized state, and the function of reducing NOx which rhodium has is significantly declined. Accordingly, at the time of return from fuel cut, the required air-fuel ratio is desirably made rich in order to reduce the rhodium in an oxidized state quickly to recover its function. However, if the change speed of the required air-fuel ratio is lessened in such a situation, recovery of the function of rhodium is delayed, and a large amount of NOx is resultantly released from the catalytic device without being purified. More specifically, reduction in emission performance is caused.

An object of the present invention is to enhance precision of realization of a required torque while enhancing emission performance by positively changing an air-fuel ratio. In order to attain such an object, the present invention provides a control device for an internal combustion engine as follows.

The control device provided by the present invention acquires the required torque of an internal combustion engine and acquires a required air-fuel ratio, and generates a target air-fuel ratio by lessening a change speed of the required air-fuel ratio which is acquired. However, in a situation in which the required air-fuel ratio is made rich with return from fuel cut, lessening of the change speed of the required air-fuel ratio is stopped, and the required air-fuel ratio is directly outputted as the target air-fuel ratio. The present control device calculates a target air quantity for realizing the required torque under the target air-fuel ratio. For calculation of the target air quantity, data in which a relationship of torque generated by the internal combustion engine and an air quantity taken into a cylinder is fixed by being related to an air-fuel ratio can be used. The present control device manipulates an actuator for air quantity control in accordance with the target air quantity, and manipulates an actuator for fuel injection quantity control in accordance with the target air-fuel ratio.

According to the control device which is configured as above, the required air-fuel ratio with the change speed thereof being lessened is used for calculation of the target air quantity, and therefore, a response delay of the actual air quantity with respect to the target air quantity can be eliminated or sufficiently reduced. As a result, according to the present control device, a delay of change of the air quantity with respect to change of the air-fuel ratio can be eliminated or sufficiently reduced, and high precision of torque realization can be kept.

Meanwhile, in the situation in which the required air-fuel ratio is made rich with return from fuel cut, the required air-fuel ratio is directly used for calculation of the target air quantity, and therefore, the exhaust gas which is made rich is supplied to the exhaust emission control device and the function of rhodium can be recovered early. Thereby, NOx is prevented from being released in the air without being purified, and the emission performance is kept in a high state. As a result that lessening of the change speed of the required air-fuel ratio is stopped, the torque generated by the internal combustion engine temporarily becomes higher than the required torque. However, torque variation to a certain degree originally occurs at the time of return from fuel cut, and therefore, even if the torque at the time of return temporarily becomes higher than the required torque, the effect which this has on drivability is extremely small.

DESCRIPTION OF EMBODIMENTS

An embodiment of the present invention will be described with reference to the drawings.

An internal combustion engine (hereinafter, an engine) which is an object to be controlled in the embodiment of the present invention is a spark ignition type four-cycle reciprocal engine. In an exhaust passage of the engine, a catalytic device with noble metals such as platinum, palladium and rhodium as a catalyst is provided. A control device controls an operation of the engine by manipulating actuators included in the engine. The actuators which can be manipulated by the control device include an ignition device, a throttle, a fuel injection device, a variable valve timing mechanism, an EGR device and the like. However, in the present embodiment, the control device manipulates a throttle, an ignition device and a fuel injection device, and the control device manipulates the three actuators to control the operation of the engine.

The control device of the present embodiment uses torque, an air-fuel ratio and an efficiency as control variables of the engine. To be exact, the torque mentioned here means indicated torque, and the air-fuel ratio means the air-fuel ratio of a mixture gas which is provided for combustion. The efficiency in the present specification means the ratio of the torque which is actually outputted to potential torque which the engine can output. The maximum value of the efficiency is 1, and at this time, the potential torque which the engine can output is directly outputted actually. When the efficiency is smaller than 1, the torque which is actually outputted is smaller than the potential torque which the engine can output, and the margin thereof mainly becomes heat and is outputted from the engine.

Figure 1:
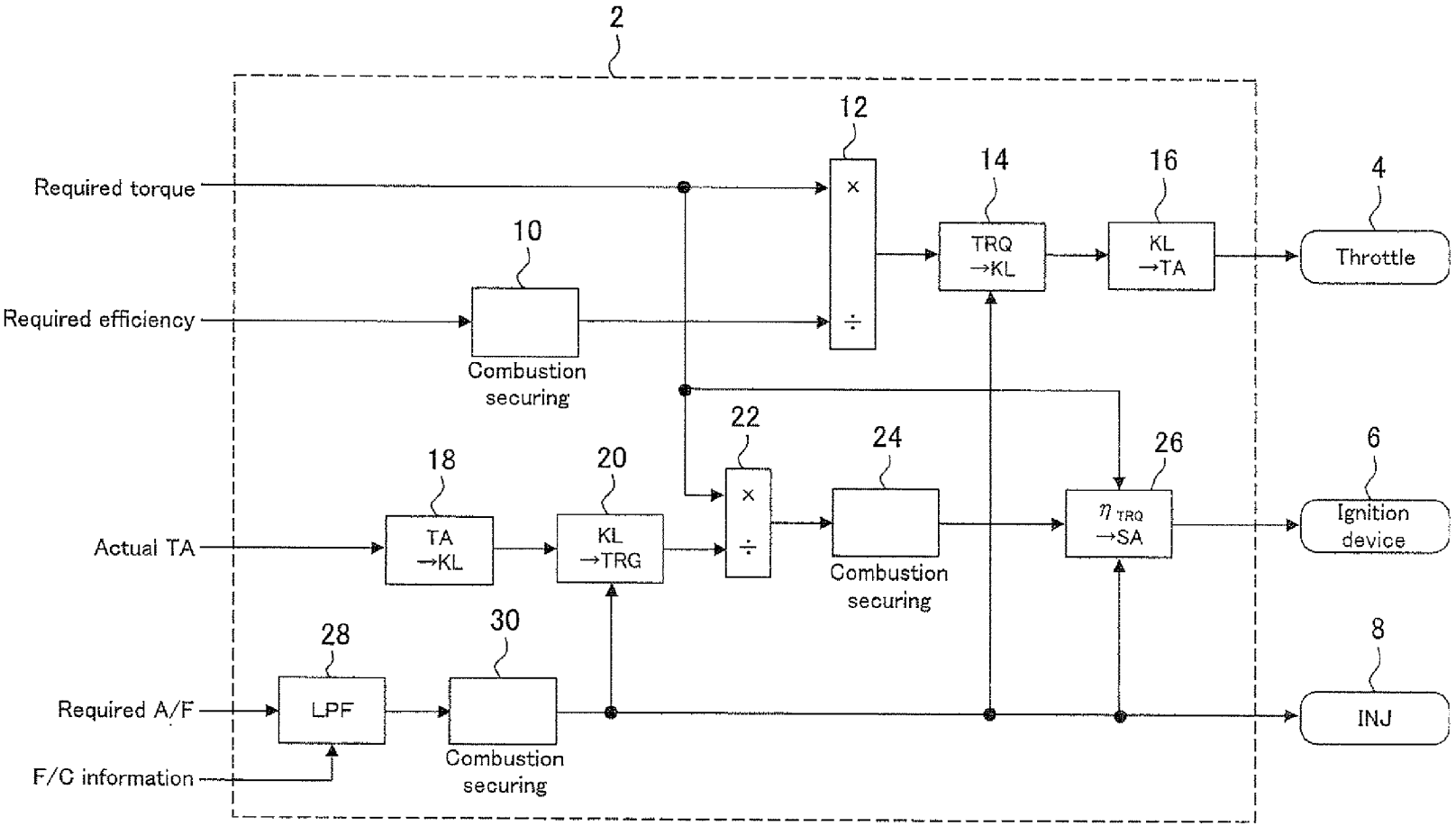
FIG. 1 is a block diagram showing a configuration of a control device of an embodiment of the present invention.

A control device 2 shown in a block diagram of FIG. 1 shows a configuration of the control device of the present embodiment. The control device 2 can be divided into a combustion securing guard section 10, an air quantity control torque calculating section 12, a target air quantity calculating section 14, a throttle opening calculating section 16, an estimated air quantity calculating section 18, an estimated torque calculating section 20, an ignition timing control efficiency calculating section 22, a combustion securing guard section 24, an ignition timing calculating section 26, a target air-fuel ratio generating section 28, and a combustion securing guard section 30, according to the functions which these sections have. These elements 10 to 30 are result of especially expressing, in the diagram, only the elements relating to torque control and air-fuel ratio control by operation of the three actuators, that is, the throttle 4, the ignition device 6 and the fuel injection device (INJ) 8, out of various functional elements which the control device 2 has. Accordingly, FIG. 1 does not mean that the control device 2 is configured by only these elements. Each of the elements may be configured by exclusive hardware, or may be virtually configured by software with the hardware shared by each of the elements. Hereinafter, the configuration of the control device 2 will be described with particular emphasis on the functions of the elements 10 to 30.

First, a required torque, a required efficiency and a required air-fuel ratio (required A/F) are inputted in the present control device as requirements to the control variables of the engine. These requirements are supplied from a power train manager which is located at a higher order than the present control device. The required torque is set in accordance with the operation conditions and the operation state of the engine, more specifically, based on the manipulated variable of an accelerator pedal by a driver, and signals from the control systems of the vehicle such as VSC and TRC. The required efficiency is set at a value smaller than 1 when the temperature of the exhaust gas is desired to be raised, and when a reserve torque is desired to be made. However, in the present embodiment, the required efficiency is assumed to be set at 1 which is the maximum value. The required air-fuel ratio is usually set at stoichiometry, but is changed when necessary from the viewpoint of emission performance. More specifically, the required air-fuel ratio is periodically changed with stoichiometry as a center in order to enhance the purification performance of a catalyst, and the required air-fuel ratio is changed by air-fuel ratio feedback control. Further, at the time of return from fuel cut, the required air-fuel ratio is changed to be richer than stoichiometry for a predetermined period of time in order to reduce rhodium contained in the catalyst quickly to recover the function thereof.

The required torque and the required efficiency received by the control device 2 are inputted in the air quantity control torque calculating section 12. The air quantity control torque calculating section 12 calculates air quantity control torque by dividing the required torque by the required efficiency. When the required efficiency is smaller than 1, the air quantity control toque is increased more than the required torque. This means that the throttle is required to be able to output torque larger than the required torque potentially. However, with regard to the required efficiency, what passes through the combustion securing guard section 10 is inputted in the air quantity control torque calculating section 12. The combustion securing guard section 10 restricts the minimum value of the required efficiency which is used for calculation of the air quantity control torque by the guard value for securing proper combustion. In the present embodiment, the required efficiency is 1, and therefore, the required torque is directly calculated as the air quantity control torque.

The air quantity control torque is inputted in the target air quantity calculating section 14. The target air quantity calculating section 14 converts air quantity control torque (TRQ) into a target air quantity (n) by using an air quantity map. The air quantity mentioned here means an air quantity which is taken into the cylinder (charging efficiency which is the result of rendering the air quantity dimensionless or a load factor can be used instead). The air quantity map is a map in which torque and an air quantity are related to each other with various engine state quantities including an engine speed and an air-fuel ratio as a key, assuming that the ignition timing is the optimum ignition timing (of the MBT and the trace knock ignition timing, whichever is more retarded) as a prerequisite. For search of the air quantity map, the actual values and the target values of the engine state quantities are used. With regard to the air-fuel ratio, the target air-fuel ratio which will be described later is used for map search. Accordingly, in the target air quantity calculating section 14, the air quantity required for realization of the air quantity control torque under the target air-fuel ratio which will be described later is calculated as the target air quantity of the engine.

The target air quantity is inputted in the throttle opening calculating section 16. The throttle opening calculating section 16 converts the target air quantity (KL) into a throttle opening (TA) by using an inverse model of an air model. The air model is a physical model which is made by modeling the response property of the air quantity to the motion of the throttle 4, and therefore, by using the inverse model of the air model, the throttle opening which is required for achievement of the target air quantity can be inversely calculated.

The control device 2 performs manipulation of the throttle 4 in accordance with the throttle opening which is calculated in the throttle opening calculating section 16. When delay control is carried out, a deviation corresponding to a delay time occurs between the throttle opening (target throttle opening) which is calculated in the throttle opening calculating section 16 and the actual throttle opening which is realized by movement of the throttle 4.

The control device 2 carries out calculation of an estimated air quantity based on the actual throttle opening in the estimated air quantity calculating section 18, in parallel with the above described processing. The estimated air quantity calculating section 18 converts the throttle opening (TA) into the air quantity (KL) by using a forward model of the aforementioned air model. The estimated air quantity is an air quantity which is estimated to be realized by manipulation of the throttle 4 by the control device 2.

The estimated air quantity is used for calculation of the estimated torque by the estimated torque calculating section 20. The estimated torque in the present description is an estimated value of the torque which can be outputted when the ignition timing is set at an optimal ignition timing under the present throttle opening, that is, the torque which can be potentially outputted by the engine. The estimated torque calculating section 20 converts the estimated air quantity into the estimated torque by using a toque map. The torque map is an inverse map of the aforementioned air quantity map, and is a map in which the air quantity and torque are related with various engine state quantities as the key on the precondition that the ignition timing is an optimal ignition tinting. In search of the torque map, the target air-fuel ratio which will be described later is used for search of the map. Accordingly, in the estimated torque calculating section 20, the torque which is estimated to be realized by the estimated air quantity under the target air-fuel ratio which will be described later is calculated.

The estimated torque is inputted in the ignition timing control efficiency calculating section 22 together with the duplicated target torque. The ignition timing control efficiency calculating section 22 calculates the ratio of the target torque to the estimated torque as an ignition timing control efficiency. The calculated ignition timing control efficiency is inputted in the ignition timing calculating section 26 after passing through the combustion securing guard section 24. The combustion securing guard section 24 restricts the minimum value of the ignition timing control efficiency by the guard value which secures combustion.

The ignition timing calculating section 26 calculates an ignition timing (SA) from the inputted ignition timing control efficiency ($\eta_{TRQ}$). In more detail, the optimal ignition timing is calculated based on the engine state quantities such as the engine speed, the required torque and the target air-fuel ratio, and calculates a retard amount with respect to the optimal ignition timing from the ignition timing control efficiency which is inputted. Subsequently, what is obtained by adding the retard amount to the optimal ignition timing is calculated as a final ignition timing. For calculation of the optimal ignition timing, a map in which the optimal ignition timing and the various engine state quantities are related with one another can be used, for example. For calculation of the retard amount, a map in which the retard amount and the ignition timing control efficiency, and various engine state quantities are related with one another can be used, for example. When the ignition timing control efficiency is 1, the retard amount is set as zero, and as the ignition timing control efficiency is smaller than 1, the retard amount is made larger.

The control device 2 performs manipulation of the ignition device 6 in accordance with the ignition timing calculated in the ignition timing calculating section 26.

Further, the control device 2 carries out processing for generating the target air-fuel ratio of the engine from the required air-fuel ratio in the target air-fuel ratio generating section 28 in parallel with the above described processing. The target air-fuel ratio generating section 28 includes a low-pass filter (for example, a first-order lag filter). The target air-fuel ratio generating section 28 passes the signal of the required air-fuel ratio which is inputted in the control device 2 through the low-pass filter, and outputs the signal which passes through the low-pass filter as the target air-fuel ratio. More specifically, the target air-fuel ratio generating section 28 generates the target air-fuel ratio by lessening the change speed of the required air-fuel ratio by the low-pass filter. However, in the situation in which the required air-fuel ratio is made rich with return from fuel cut (F/C), lessening of the change speed of the required air-fuel ratio is not performed. In this case, the target air-fuel ratio generating section 28 directly outputs the required air-fuel ratio which is not passed through the low-pass filter as the target air-fuel ratio.

Figure 2:
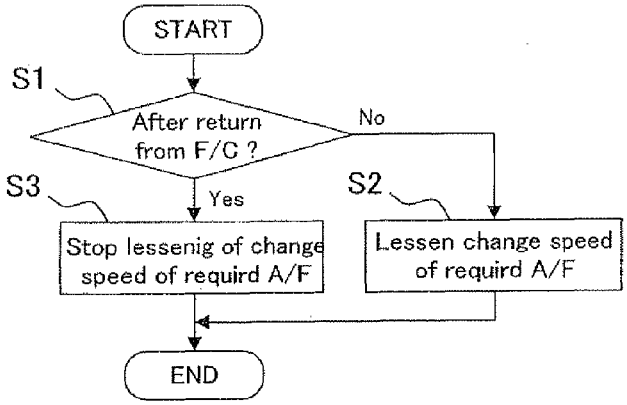
FIG. 2 is a flowchart showing processing carried out in the control device of the embodiment of the present invention.

FIG. 2 is a diagram expressing the processing performed in the target air-fuel ratio generating section 28 in a flowchart. According to the flowchart, whether it is after return from fuel cut is determined in the first step S1. "After return from fuel cut" mentioned here means the period in which fuel injection is restarted and the required air-fuel ratio continues to be rich. If the determination result of step S1 is negative, the required air-fuel ratio with the change speed lessened by the low-pass filter is outputted as the target air-fuel ratio (step S2). If the determination result of step S1 is affirmative, lessening of the change speed of the required air-fuel ratio is stopped, and the required air-fuel ratio is directly outputted as the target air-furl ratio (step S3).

The target air-fuel ratio which is generated in the target air-fuel ratio generating section 28 passes through the combustion securing guard section 30, and thereafter, is supplied to the target air quantity calculating section 14, the estimated torque calculating section 20, the ignition timing calculating section 26, and the fuel injection device 8. The combustion securing guard section 30 restricts the maximum value and the minimum value of the target air-fuel ratio by the guard value for securing proper combustion.

The control device 2 performs manipulation of the fuel injection device 8 in accordance with the target air-fuel ratio. In more detail, the control device 2 calculates the fuel injection quantity from the target air-fuel ratio and the estimated air quantity, and manipulates the fuel injection device 8 so as to realize the fuel injection quantity.

Figure 3:
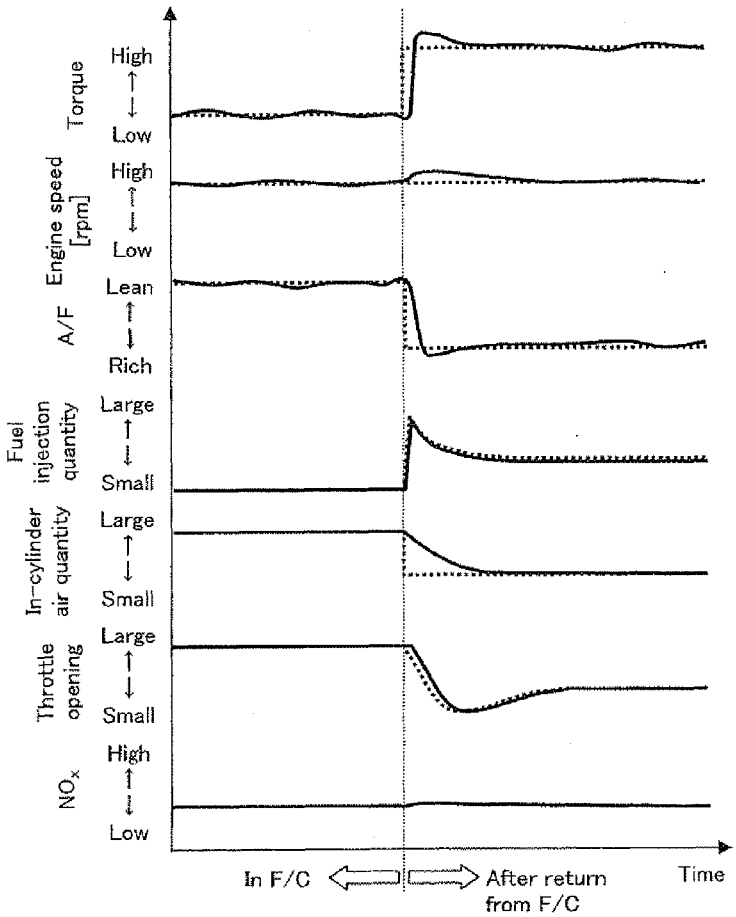
FIG. 3 is a diagram for explaining a content of engine control according to the embodiment of the present invention and a control result thereof.
Figure 4:
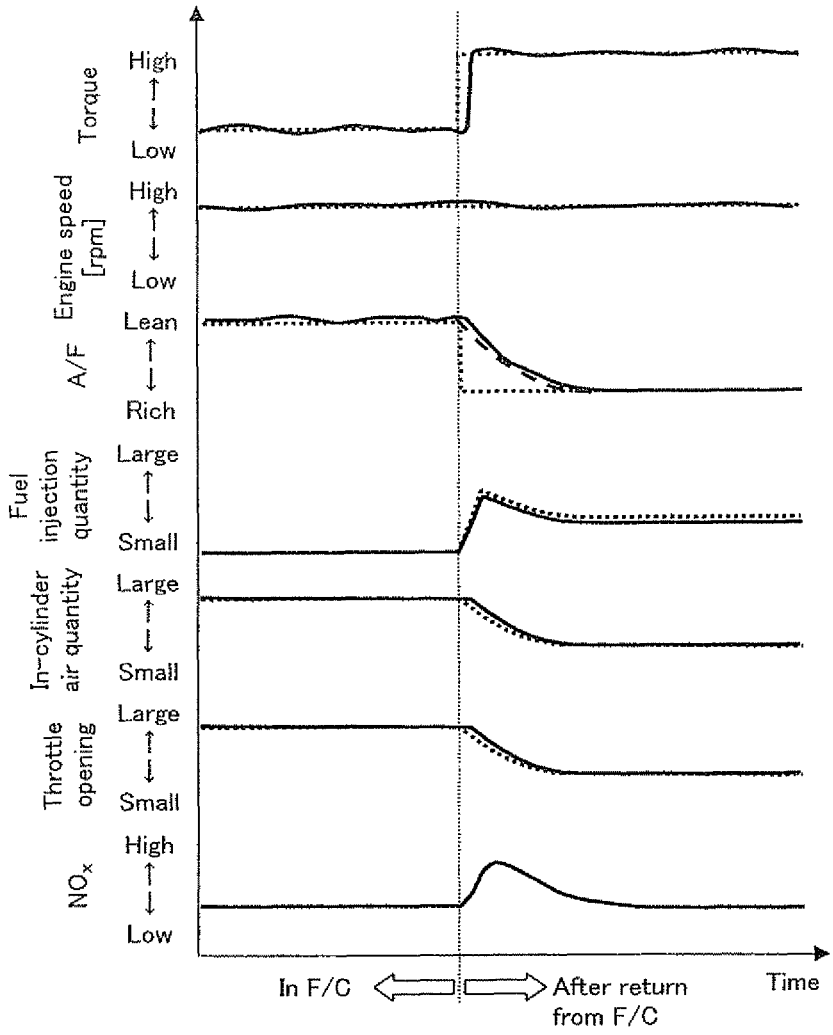
FIG. 4 is a diagram for explaining a content of engine control as a comparative example and a control result thereof.

FIG. 3 is a diagram showing a result of engine control which is realized by the control device 2 in the present embodiment. Meanwhile, FIG. 4 is a diagram showing a result of carrying out engine control as a comparative example. In the comparative example, processing of lessening the change speed of the required air-fuel ratio by the low-pass filter is always carried out. Hereinafter, the effect in engine control which is obtained in the present embodiment will be described by being compared with the comparative example.

Charts of respective stages of FIGS. 3 and 4 show changes with time of control variables and state quantities before and after return from fuel cut. In the chart on each of the uppermost stages, a change with time of the required torque is shown by the dotted line, and a change with time of the torque which is actually generated by the engine is shown by the solid line. In the chart at each of the second stages, a change with time of the target engine speed is shown by the dotted line, and a change with time of the actual engine speed is shown by the solid line. In the chart at each of the third stages, a change with time of the required air-fuel ratio is shown by the dotted line, a change with time of the target air-fuel ratio is shown by the broken line, and a change with time of the actual air-fuel ratio is shown by the solid line. In the chart at each of the fourth stages, a change with time of the target fuel injection quantity which is calculated from the target air-fuel ratio is shown by the dotted line, and a change with time of the actual fuel injection quantity is shown by the solid line. In the chart at each of the fifth stages, a change with time of the target air quantity is shown by the dotted line, and a change with time of the actual air quantity taken into the cylinder is shown by the solid line. In the chart at each of the sixth stages, a change with time of the target throttle opening is shown by the dotted line, and a change with time of the actual throttle opening is shown by the solid line. In the chart at each of the lowermost stages, a change with time of the NOx concentration in the exhaust gas exhausted from the catalytic device is shown by the solid line.

As shown in the chart at the third stage of each of the drawings, at the time of return from fuel cut, the required air-fuel ratio takes on the semblance of a step signal and is changed to a rich side. In the comparative example shown in FIG. 4, the step signal is processed by the low-pass filter, and thereby, the signal of the target air-fuel ratio which gradually changes to the rich side is generated. The target air-fuel ratio which gradually changes is used for calculation of the target air quantity, whereby the change of the target air quantity becomes gradual as shown in the chart at the fifth stage of FIG. 4, and the response delay of the actual air quantity with respect to the target air quantity is sufficiently reduced. As a result, a delay of the change of the air quantity with respect to the change of the air-fuel ratio is also sufficiently decreased, and both torque and engine speed can be controlled as the target. Meanwhile, however, as shown in the chart at the lowermost stage of FIG. 4, the NOx concentration in the exhaust gas which is exhausted from the catalytic device temporarily increases. This is because the gas which is sufficiently made rich at the time of return from fuel cut cannot be supplied to the catalytic device, and recovery of the function of rhodium is delayed.

In contrast with the above, in the present embodiment shown in FIG. 3, the step signal of the required air-fuel ratio is directly outputted as the target air-fuel ratio. Thereby, the target air quantity which is calculated from the target air-fuel ratio takes on the semblance of a step signal and decreases, and the response delay of the actual air quantity with respect to the target air quantity becomes noticeable. As a result, a delay occurs to the change of the air quantity with respect to the change of the air-fuel ratio, and the torque generated by the engine temporarily surpasses the required torque directly after return from fuel cut. Further, the engine speed also temporarily surpasses the target engine speed. However, return from fuel cut is due to manipulation of the accelerator by a driver himself, and the driver does not have a sense of incompatibility in the torque increasing stepwise by the accelerator manipulation. Accordingly, even if the torque at the time of return temporarily becomes higher than the required torque, the effect given to drivability by this is very small. Meanwhile, with respect to the emission performance which is given the highest priority among various engine performances today, increase in the NOx concentration directly after return from the fuel cut is prevented as shown in the chart at the lowermost stage of FIG. 3. This is because according to the present embodiment, the gas which is sufficiently made rich is supplied to the catalytic device at the time of return from fuel cut, whereby the rhodium in the oxidized state is quickly reduced and the function thereof can be recovered.

The embodiment of the present invention is described above, but the present invention is not limited to the aforementioned embodiments, and can be carried out by being variously modified in the range without departing from the gist of the present invention. For example, in the aforementioned embodiment, the throttle is used as the actuator for air quantity control, but an intake value with a variable lift quantity or working angle can be used.

Further, in the aforementioned embodiment, the change speed of the required torque is lessened by the low-pass filter, but so-called modulating processing may be used. As one example of modulating processing, weighted average can be cited. Alternatively, by applying guard processing to the change rate of the required torque, the change speed can be lessened.

Further, in the aforementioned embodiment, torque, an air-fuel ratio and an efficiency are used as the control variables of the engine, but only torque and an air-fuel ratio may be used as the control variables of the engine. More specifically, the efficiency can be always fixed to 1. In such a case, the target torque is directly calculated as the torque for air quantity control.

DESCRIPTION OF REFERENCE NUMERALS

2 Controller
4 Throttle
6 Ignition device
8 Fuel injection device
10 Combustion securing guard section
12 Air quantity control torque calculating section
14 Target air quantity calculating section
16 Throttle opening calculating section
18 Estimated air quantity calculating section
20 Estimated torque calculating section
22 Ignition timing control efficiency calculating section
24 Combustion securing guard section
26 Ignition timing calculating section
28 Target air-fuel ratio generating section
30 Combustion securing guard section

The invention claimed is:

1. A control device for an internal combustion engine, comprising:

requirement acquiring means that acquires a required torque and a required air-fuel ratio of the internal combustion engine;

target air-fuel ratio generating means that generates a target air-fuel ratio by lessening a change speed of the required air-fuel ratio;

target air quantity calculating means that calculates a target air quantity for realizing the required torque under the air-fuel ratio, based on data in which a relationship of torque generated by the internal combustion engine and an air quantity which is taken into a cylinder is fixed by being related to an air-fuel ratio;

air quantity control means that manipulates an actuator for air quantity control in accordance with the target air quantity; and fuel injection quantity control means that manipulates an actuator for fuel injection quantity control in accordance with the target air-fuel ratio, wherein the target air-fuel ratio generating means stops lessening of the change speed of the required air-fuel ratio, and directly outputs the required air-fuel ratio as the target air-fuel ratio, in a situation in which the required air-fuel ratio is made rich with return from fuel cut.

2. A control device for an internal combustion engine, comprising:

a unit that acquires a required torque and a required air-fuel ratio of the internal combustion engine;

a unit that generates a target air-fuel ratio by lessening a change speed of the required air-fuel ratio;

a unit that calculates a target air quantity for realizing the required torque under the air-fuel ratio, based on data in which a relationship of torque generated by the internal combustion engine and an air quantity which is taken into a cylinder is fixed by being related to an air-fuel ratio;

a unit that manipulates an actuator for air quantity control in accordance with the target air quantity; and a unit that manipulates an actuator for fuel injection quantity control in accordance with the target air-fuel ratio, wherein the target air-fuel ratio generating unit stops lessening of the change speed of the required air-fuel ratio, and directly outputs the required air-fuel ratio as the target air-fuel ratio, in a situation in which the required air-fuel ratio is made rich with return from fuel cut.

* * * * *